US007468663B1

(12) United States Patent
Rufolo, Jr. et al.

(10) Patent No.: US 7,468,663 B1
(45) Date of Patent: Dec. 23, 2008

(54) BUILDING SECURITY SYSTEM

(76) Inventors: Michael J. Rufolo, Jr., 12 Colton Ct., Bayville, NJ (US) 08721; Michael J. Shannon, 1043 Kells Ct., Toms River, NJ (US) 08753

( * ) Notice: Subject to any disclaimer, the term of this patent is extended or adjusted under 35 U.S.C. 154(b) by 296 days.

(21) Appl. No.: 11/595,084

(22) Filed: Nov. 9, 2006

(51) Int. Cl.
*G08B 13/00* (2006.01)

(52) U.S. Cl. ..... 340/541; 340/540; 340/571; 348/143; 348/160; 348/370; 348/377

(58) Field of Classification Search ..... 340/541, 340/540, 571; 348/143, 160, 370, 377
See application file for complete search history.

(56) References Cited

U.S. PATENT DOCUMENTS 5,990,938 A * 11/1999 Bern ..... 348/152
2003/0061621 A1* 3/2003 Petty et al. ..... 725/105

* cited by examiner

*Primary Examiner*—Tai T Nguyen
(74) *Attorney, Agent, or Firm*—Michael R. Philips

(57) ABSTRACT

A building security system includes a visible video camera and a hidden video camera in each room. Personnel in each room carries a portable signaling device that includes a level sensor to automatically generate a signal indicating the personnel is down. Each room has remotely controlled door locks. All cameras, signaling devices and locks are linked to a security station including a router and computer. Police are provided with secure codes to obtain access to the computer, view the video and communicate with selected rooms in the building.

7 Claims, 2 Drawing Sheets

Fig. 2

1. Threat in facility perceived by personnel // situation captured on cameras.
2. Personnel triggers VOIP silent alarm or automatic person down alarm.
3. Alarm received at security station // video display checked.
4. Does a threat exist?
5. No // disengage alarm.
6. Yes // call for help; lock down threatened area; check if other areas are affected.
7. Activate pre-recorded message to threatened area // alert non-endangered areas of existence of threat.
8. Help (police) arrive // access video display from police vehicle. Assess threat. Display includes premises map highlighting threatened area.
9. Police establish voice contact with intruder via VOIP link.
10. Police resolve threat.
11. Release lock down // communicate all-clear.

BUILDING SECURITY SYSTEM

FIELD OF THE INVENTION

The present invention relates to the field of security systems, and more particularly to security systems having internal audio and video communication equipment.

BACKGROUND OF THE INVENTION

It has become too common that an armed individual enters a school or other building and threatens or injures occupants. The individual is often an outsider, as in the case of the Amish school incident, or a school student, as in the Columbine killings. This problem occurs also in offices, banks, and many other public or semi-public buildings. Public buildings such as courthouses have installed metal detectors and posted guards. Many larger schools have hired guards or actual police. These security measures have been somewhat effective, but those who are sufficiently motivated or deranged tend to find ways to circumvent the gatekeeping protections.

Once an incident has begun, the security personnel or police that arrive are unaware of the details of the situation within the facility. This lack of current information hinders resolution, since the police or security may not know the number of intruders, type and number of weapons, and the actual conditions. Attempts to negotiate with the intruder and bargain a solution are critical. This can only be helpful if a communication link is accessible. When the threat occurs in a school building, direct communication with a specific room is often not available, and broadcasting negotiations to multiple rooms is likely to add panic to the situation.

SUMMARY OF THE INVENTION

The building security system of the present invention relates to any public or semi-public building. A security station connects each room, e.g. classroom, via a router to a computer. Each room and hall contains a visible camera and a second camera that is hidden from view. Each room and hall also has a door that may be locked from a remote location to prevent threatening intruders from exiting the room. Each room has a portable signaling device, preferably carried by room personnel, i.e. a teacher, by which a signal may be sent manually or automatically in case the teacher falls. The signal alerts security personnel who confirm the existence of a threat and contact police. The police are able to obtain audio and video information of the endangered room through the computer and communicate with the intruders.

BRIEF DESCRIPTION OF THE DRAWINGS

The present invention is best understood in conjunction with the accompanying drawing figures in which like elements are identified by similar reference numerals and wherein:

FIG. 2 is a flowchart listing of steps involved in practicing the security system of the invention.

DETAILED DESCRIPTION OF THE PREFERRED EMBODIMENT

Figure 1:
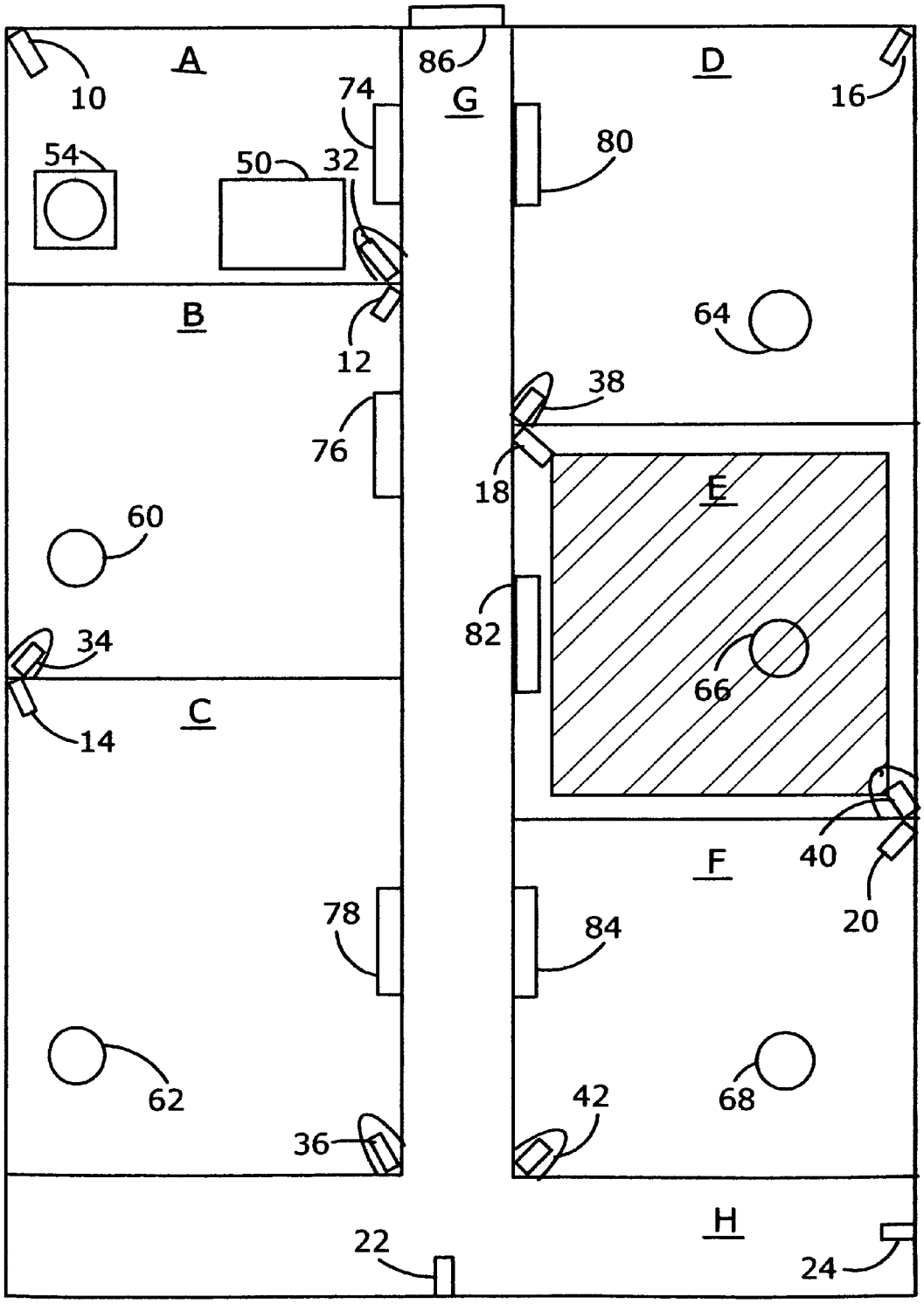
FIG. 1 is a diagrammatic floor plan of a building having plural segregated areas equipped with the security system of the invention.

Referring now to FIG. 1, a building, for example a school building, is illustrated in diagrammatic plan view as having a number of segregated areas, such as a security station A, a plurality of classrooms B-F, and two intersecting hallways G and H. Classroom E is shown highlighted to indicate the existence of a possible security threat therein. While the preferred embodiment of the invention relates to security in a school building, it is to be understood that the invention relates to any building, public or private, where improved security protection is desired.

Each classroom B-F is similarly equipped. Referring now to endangered classroom E, a first camera 18 is mounted in plain view in a location from which a view can be taken of the major portion of classroom E. Camera 18 is a closed circuit television (CCTV) camera that is either hard wired or wireless, as is known. Whereas security cameras are well known and an intruder intent on causing a threat or injury could incapacitate camera 18, a second camera 40 is mounted at a second location. Second camera 40 is mounted in a manner to be virtually invisible, for example within a wall-mounted clock, a hung picture, or within the wall structure. Hidden camera 40 is also a CCTV type and either wired or wireless. In each of classrooms B-F, hidden cameras 34-42 are illustrated as being encased in an obscuring elliptical housing. The presence of a hidden camera 40 ensures a view of the endangered area independent of the visible camera. Security station A contains a router 50 to which all cameras and other audio and video equipment are connected. Router 50 may be wired or wireless, or a combination of both, depending on the needs of the system being used. A computer 54 is also located in security station A and in operative communication with router 50 for recording of video and audio data and for communication with external devices. Router 50 and computer 54 operate cooperatively as a communication center, enabling transmission of audio and video with each of classrooms B-F as well as hallways G and H. Visible camera 18 and hidden camera 40 operate independently to capture situations in classroom E, and are viewed on receipt of a signal, or randomly during the course of the day. Security station A is equipped with visible camera 10 as well as hidden camera 32 to provide a view for police of this area.

Returning to classroom E, a signaling device 66 is available to personnel, e.g. a teacher. Signaling device 66 is preferably wireless and secretly worn by the teacher in order to enable an emergency signal from any location in classroom E. Signaling device 66 is adapted with a level sensor to automatically generate a signal should the teacher wearing signaling device 66 fall to the floor, causing the level sensor to change from a vertical orientation to a horizontal orientation. When a signal is generated by signaling device 66, either by intentional contact or by the teacher falling, the signal is transmitted to security station A where security personnel are alerted. On the possibility that the teacher may fall due to tripping or other non-threatening event, signaling device 66 includes a delay in the level sensor circuit before activating a signal. The security personnel will first use computer 54 to display the scene from one or both of visible camera 18 and hidden camera 40 to determine the nature of the situation. Computer 54 is programmed with software for simplified viewing of classroom camera images and communication to a single classroom or multiple classrooms as well as the remote controlling of classroom locks. A building security person or an outside police officer is thus able to readily view and respond to a problem by clicking a menu tab displayed on the screen. If the situation warrants, for example an armed intruder in the signaling classroom, a further signal is transmitted by secure linkage to a local police station. The security personnel would then scan other classrooms B-F and hallways G and H to determine the extent of the situation. Police cars today are equipped with laptop computers that can communicate with computer 54 in security station A. Other wireless communication devices, such as a Blackberry®, are also usable. Police or other appropriate authorities are provided with a secure password to be used in order to remotely connect to computer 54 and view the building plan, the location of the endangered classroom and the transmitted pictures from various cameras. Police will also be able to communicate by VOIP (voice over internet protocol) link through computer 54 to endangered classroom E or other areas in the building. Displaying to security personnel and police the actual situation in the endangered area, how many intruders, whether the intruders are armed, type and mannerism of intruders, helps to eliminate police guesswork therefore improving the chance of a successful resolution. All audio or video communications are handled by router 50, whether to computer 54 or directly to a classroom. The system capability of allowing security personnel or police to speak directly with the intruders, rather than through a phone that may not be available or functioning, improves the quality of communication and also the resolution of the situation.

Classroom E is equipped with a remotely controlled lockable door 82. Door 82 may be remotely locked to prevent an intruder from entering classroom E. In addition, an intruder can be confined to hallway G after locking door 82 and outer door 86. All door locks 74-86 are controlled through computer 54, either from security station A or from a police communication device. It is preferred that door 74 of security station A remain generally locked because of the special importance of this area. All classrooms B-F have similar cameras, remotely lockable doors and portable signaling devices as described in relation to classroom E.

Referring now to FIG. 2, a process chart of the steps involved in the invention method are described. In step 1, a threat in the form of an armed intruder in a classroom is perceived and video of the situation is obtained and transmitted to the security station. Personnel in the classroom, for example a teacher, activates a silent alarm in step 2 either by touching a switch or by falling to activate the level sensor switch. In step 3 the alarm is received in the security office and the video display corresponding to the endangered classroom is reviewed. The security personnel determine whether a threat exists. If no actual threat exists (alarm accidentally triggered/teacher fell) the alarm is deactivated in step 5. If a threat exists, security personnel contact police in step 6, lock appropriate doors to prevent the intruder from escaping and check other areas of the building by camera scan techniques. Security personnel activate an automated taped message to the endangered classroom and alert other classrooms of the situation in step 7. Help in the form of police arrive in step 8, access video information of the inside situation, review a building plan and assess the threat. Police establish voice contact with the intruder via VOIP in step 9. Police resolve the threat in step 10. The locked areas are opened and an all clear message is communicated to all areas of the building in step 11.

While the description above discloses preferred embodiments of the present invention, it is contemplated that numerous variations and modifications of the invention are possible and are considered to be within the scope of the claims that follow. Further, the description of the invention in the context of a school is presented as a preferred embodiment and not as a limitation, it being understood that the invention has application to buildings of various functions.

What is claimed is:

1. A security system for a building having plural segregated areas, comprising:

a. a security station;

b. a visible video device in each of the segregated areas that is susceptible to be incapacitate by an intruder, the visible video devices being in communication with the security station;

c. a hidden video device in each of the segregated areas, the hidden video devices being in communication with the security station, whereas if the visible video device becomes incapacitated by the intruder, the intruder thus believing that the entire video system in the segregates area has been incapacitated, the hidden video device continues to function to transmit signal to the security station;

d. a hidden, portable signaling device in reach of personnel in each of the segregated areas, the signaling devices being in communication with the security station; and e. two-way audio communication links between each of the segregated areas and the security station.

2. The security system described in claim 1, further comprising means for police or other authorized external personnel to obtain access to the security station and to view a floor plan of a building.

3. The security system described in claim 2, wherein the floor plan displayed to police or other authorized external personnel includes an indicator of the area affected by a potential endangerment.

4. The security system described in claim 2, wherein the means for police or other authorized external personnel to obtain access to the security station includes a security code authentication process.

5. The security system described in claim 1, further comprising means for police or other authorized external personnel to receive audio and video communication from selected areas within the building.

6. The security system described in claim 1, further comprising remotely controllable locks for securing each of the segregated areas.

7. The security system described in claim 1, wherein each of the hidden portable signaling devices comprises a level sensor to automatically generate a signal when being moved from a vertical orientation to a horizontal orientation.

* * * * *